US006609390B1

(12) United States Patent
Ueno et al.

(10) Patent No.: US 6,609,390 B1
(45) Date of Patent: Aug. 26, 2003

(54) TWO-REFRIGERANT REFRIGERATING DEVICE

(75) Inventors: Akitoshi Ueno, Osaka (JP); Takeo Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/787,901

(22) PCT Filed: Sep. 29, 1999

(86) PCT No.: PCT/JP99/05306

§ 371 (c)(1),
(2), (4) Date: Mar. 28, 2001

(87) PCT Pub. No.: WO00/19157

PCT Pub. Date: Apr. 6, 2000

(30) Foreign Application Priority Data

Sep. 30, 1998 (JP) ..... 10-277033

(51) Int. Cl.[7] ..... F25B 7/00
(52) U.S. Cl. ..... 62/335; 62/79
(58) Field of Search ..... 62/79, 335

(56) References Cited

U.S. PATENT DOCUMENTS

| | | | | |
|---|---|---|---|---|
| 3,392,541 A | * | 7/1968 | Nussbaum | 62/335 |
| 3,824,804 A | * | 7/1974 | Sandmark | 62/238.3 |
| 4,149,389 A | * | 4/1979 | Hayes et al. | 62/114 |
| 5,388,420 A | | 2/1995 | Yoshida et al. | |
| 5,826,443 A | * | 10/1998 | Ares et al. | 165/66 |

FOREIGN PATENT DOCUMENTS

| | | | |
|---|---|---|---|
| CN | 1151008 A | | 6/1997 |
| CN | 1169771 A | | 1/1998 |
| GB | 2 273 763 A | | 6/1994 |
| JP | 49-12702 | | 3/1974 |
| JP | 58-178159 | | 10/1983 |
| JP | 59-38568 | * | 2/1984 |
| JP | 59-38568 A | | 3/1984 |
| JP | 59-38568 | | 3/1984 |
| JP | 60-121166 U | | 8/1985 |
| JP | 1-144770 U | | 10/1989 |
| JP | 7-243726 | | 9/1995 |

(List continued on next page.)

OTHER PUBLICATIONS

Microfilm of the specification and drawings annexed to the request of Japanese Utility Model Application No. 41102/1988 (Laid–open No. 144770/1989) (Mitsubishi Heavy Industries, Ltd.) Oct. 4, 1989.

Microfilm of the specification and drawings annexed to the request of Japanese Utility Model Application No. 9877/1984 (Laid–open No. 121166/1985) (Mitsubishi Electric Corporation), Aug. 15, 1985.

Microfilm of the specification and drawings annexed to the request of Japanese Utility Model Application No. 191063/1983 (Laid–open No. 98462/1985) (Mitsubishi Heavy Industries, Ltd.), Jul. 6, 1985.

European Search Report, Application No. 99969787.3–1266–JP9905306, Mailing Date: Sep. 9, 2002.

*Primary Examiner*—William E. Tapolcai
(74) *Attorney, Agent, or Firm*—Nixon Peabody LLP; Donald R. Studebaker

(57) ABSTRACT

A two-stage cascade refrigerating system including a primary side refrigerant circuit, and at least one secondary side refrigerant circuit. The receiver of the primary refrigerant circuit is arranged such that a first pipe is introduced to the inside of the container such that an open of the first pipe is located at an inside upper portion of the container, and a second pipe is introduced to the inside of a container such that an open end of the second pipe is located at an inside lower portion of the container. The receiver of the secondary side refrigerant circuit(s) is reversible in refrigerant circulation and is arranged such that a first pipe and a second pipe are introduced to the inside of the container such that open ends of both pipes are located at an inside lower position of the container.

4 Claims, 2 Drawing Sheets

FOREIGN PATENT DOCUMENTS

| | | |
|---|---|---|
| JP | 9-53861 A | 2/1997 |
| JP | 9-196516 A | 7/1997 |
| JP | 9-210515 | 8/1997 |
| JP | 10-170107 | 6/1998 |
| JP | 10-170107 A | 6/1998 |
| WO | WO 96/12921 | 5/1996 |

* cited by examiner

TWO-REFRIGERANT REFRIGERATING DEVICE

TECHNICAL FIELD

This invention relates to a two-stage cascade refrigerating system and particularly relates to the structure of a receiver.

BACKGROUND ART

A two-stage cascade refrigerating system conventionally includes a primary side refrigerant circuit and a secondary side refrigerant circuit each of which effects a refrigerating operation individually, as disclosed in Japanese Unexamined Patent Publication No. 9-210515. This two-stage cascade refrigerating system is used for obtaining temperatures as low as minus few ten degrees. This two-stage cascade refrigerating system is advantageous in energy saving since it can be used in an efficient compression ratio from a high compression ratio to a low compression ratio.

The primary side refrigerant circuit of the two-stage cascade refrigerating system is formed by connecting a compressor, a condenser, an expansion valve and an evaporation section of a refrigerant heat exchanger in this order. On the other hand, the secondary side refrigerant circuit is formed by connecting a compressor, a condensation section of the refrigerant heat exchanger, an expansion valve and an evaporator in this order. In the refrigerant heat exchanger, heat of condensation in the secondary side refrigerant circuit is exchanged with heat of evaporation in the primary side refrigerant circuit.

PROBLEMS TO BE SOLVED

In conventional two-stage cascade refrigerating systems including the above-mentioned two-stage cascade refrigerating system, the evaporator for a secondary refrigerant is frosted and therefore a defrosting operation is carried out, for example, at predetermined time intervals. As an exemplary technique of implementing such a defrosting operation, there has been proposed one which carries out a defrosting operation by changing the directions of refrigerant circulation in the primary and secondary side refrigerant circuits to respective reverse cycles.

Specifically, the primary and secondary side refrigerant circuits are provided with four-way selector valves, respectively. The primary side refrigerant circuit provides refrigerant circulation such that the refrigerant flows through the compressor, the refrigerant heat exchanger, the expansion valve and the condenser in this order and returns to the compressor. On the other hand, the secondary side refrigerant circuit provides refrigerant circulation such that the refrigerant flows through the compressor, the evaporator, the expansion valve and the refrigerant heat exchanger in this order and returns to the compressor. As a result, the frost on the evaporator in the secondary side refrigerant circuit is melted by a high-temperature refrigerant from the compressor.

Further, conventionally, the primary side refrigerant circuit is provided with a receiver between the condenser and the expansion valve to regulate a liquid refrigerant, whereas the secondary side refrigerant circuit is provided with a receiver between the refrigerant heat exchanger and the expansion valve to regulate a liquid refrigerant. However, there has been a problem in such primary and secondary side refrigerant circuits in that they cannot control a liquid refrigerant at a suitable flow rate during the defrosting operation.

Specifically, during the defrosting operation, the condenser in the primary side refrigerant circuit functions as an evaporator while the evaporation section of the refrigerant heat exchanger functions as a condenser. If the outdoor air temperature is high at the time, the evaporation capability of the condenser is increased whereas the condensation capability of the evaporation section of the refrigerant heat exchanger is steady, which causes a so-called wet operation in the system.

That is, in the receiver, two pipes introduced into its container have conventionally been set to be oriented downward. Therefore, if the liquid refrigerant in the receiver is large in amount, a large amount of liquid refrigerant will return to the compressor via the condenser. As a result, the system enters a so-called wet operation, which invites a problem of poor reliability.

Particularly for a long pipe which connects the compressor and the refrigerant heat exchanger through a large distance, the amount of refrigerant charged thereinto is essentially large. Therefore, the liquid refrigerant will be stored in large amounts in the receiver. This makes it impossible to satisfactorily prevent back of the liquid refrigerant into the compressor.

On the other hand, in the secondary side refrigerant circuit during the defrosting operation, the evaporator functions as a condenser while the condensation section of the refrigerant heat exchanger functions as an evaporator. Because of the relationship between the compressor and the evaporator which are disposed in proximity to each other, the amount of refrigerant charged into the secondary side refrigerant circuit is small. In addition, the capacity of the evaporator is large. The liquid refrigerant is therefore difficult to accumulate in the receiver. As a result, the refrigerant is difficult to return to the compressor, which makes it difficult to ensure a desired refrigerant circulating flow rate. Particularly if no pressure reduction capability is provided between the receiver and the refrigerant heat exchanger, the suction side pressure of the compressor easily drops down to a low level, which makes it impossible to ensure the desired refrigerant circulating flow rate.

The present invention has been made in view of the foregoing points and has its object of controlling a liquid refrigerant at a suitable flow rate during a defrosting operation.

DISCLOSURE OF INVENTION

Specifically, as shown in FIG. 1, a two-stage cascade refrigerating system as a first solution includes a primary side refrigerant circuit (20) which is formed by connecting a compressor (21), a condenser (22), an expansion mechanism (EV11) and an evaporation section of a refrigerant heat exchanger (11) in this order and in which a primary refrigerant circulates and a receiver (25) is disposed in a liquid line. The system also includes at least one secondary side refrigerant circuit (3A) which is formed by connecting a compressor (31), a condensation section of the refrigerant heat exchanger (11), an expansion mechanism (EV21) and an evaporator (5*a*) in this order and in which a secondary refrigerant circulates, a receiver (34) is disposed in a liquid line and the primary refrigerant exchanges heat with the secondary refrigerant in the refrigerant heat exchanger (11).

Further, said at least one secondary side refrigerant circuit (3A) and the primary side refrigerant circuit (20) are arranged to make the direction of refrigerant circulation reversible between a forward cycle and a reverse cycle. In addition, the receiver (25) of the primary side refrigerant circuit (20) includes a container (2*a*), a first pipe (2*b*) which communicates with the condenser (22) and is introduced to the inside of the container (2*a*) and an opening end of which is located at an inside upper position of the container (2*a*), and a second pipe (2*c*) which communicates with the refrigerant heat exchanger (11) and is introduced to the inside of the container (2*a*) and an opening end of which is located at an inside lower position of the container (2*a*).

A second solution is directed to a two-stage cascade refrigerating system including the primary side refrigerant circuit and the secondary side refrigerant circuit like the first solution. Further, said at least one secondary side refrigerant circuit (3A) and the primary side refrigerant circuit (20) are arranged to make the direction of refrigerant circulation reversible between a forward cycle and a reverse cycle.

Furthermore, the receiver (34) of the secondary side refrigerant circuit (3A) reversible in refrigerant circulation includes a container (3*a*), a first pipe (3*b*) which communicates with the refrigerant heat exchanger (11) and is introduced to the inside of the container (3*a*) and an opening end of which is located at an inside lower position of the container (3*a*), and a second pipe (3*c*) which communicates with the evaporator (5*a*) and is introduced to the inside of the container (3*a*) and an opening end of which is located at an inside lower position of the container (3*a*).

In addition, a pressure reduction passage (65) for allowing the flow of the secondary refrigerant therethrough during the reverse cycle of refrigerant circulation alone is provided between the refrigerant heat exchanger (11) and the receiver (34) in the secondary side refrigerant circuit (3A) reversible in refrigerant circulation, and the pressure reduction passage (65) is provided with a shut-off valve (SVDL) smaller in diameter than the passage.

A two-stage cascade refrigerating system as a third solution is arranged in the second solution so that, like the first solution, the receiver (25) of the primary side refrigerant circuit (20) includes a container (2*a*), a first pipe (2*b*) which communicates with the condenser (22) and is introduced to the inside of the container (2*a*) and an opening end of which is located at an inside upper position of the container (2*a*), and a second pipe (2*c*) which communicates with the refrigerant heat exchanger (11, 11) and is introduced to the inside of the container (2*a*) and an opening end of which is located at an inside lower position of the container (2*a*).

A fourth solution is concerned with the first or second solution, wherein a plurality of refrigerant heat exchangers (11, 11) are provided. Further, the evaporation sections of the refrigerant heat exchangers (11, 11) are connected in parallel with each other to form the primary refrigerant circuit (20), and the refrigerant heat exchangers (11, 11) are connected with the secondary side refrigerant circuits (3A, 3B), respectively. Furthermore, at least one secondary side refrigerant circuit (3A) of the plurality of secondary side refrigerant circuits (3A, 3B) is arranged to make refrigerant circulation therein reversible. In addition, the evaporators (5*a*, 5*b*) of the secondary side refrigerant circuits (3A, 3B) are formed unitarily.

In these solutions, during a defrosting operation, the primary side refrigerant circuit (20) and the secondary side refrigerant circuit (3A) together provide refrigerant circulation in reverse cycles. Particularly in the fourth solution, one secondary side refrigerant circuit (3A) alone effects a defrosting operation.

On one hand, in the secondary side refrigerant circuit (3A), the shut-off valve (SVDL) of the pressure reduction passage (65) is fully opened. The secondary refrigerant thereby discharged from the compressor (31) flows through the evaporator (50) to heat the evaporator (50) and defrost the evaporator (50). Thereafter, the secondary refrigerant flows through the receiver (34) and the pressure reduction passage (65) and is then reduced in pressure in the shut-off valve (SVDL). Subsequently, the secondary refrigerant evaporates in the condensation section of the refrigerant heat exchanger (11) and then returns to the compressor (31). The secondary refrigerant repeats this circulation.

Particularly in the second and third solutions, the secondary refrigerant flowing out the evaporator (50) flows into the container (3*a*) of the receiver (34) from the second pipe (3*c*) and then flows out from the first pipe (3*b*). At the time, since the opening end of the first pipe (3*b*) is located at the lower position of the container (3*a*), the secondary refrigerant in liquid phase is easy to flow out. Further, since the shut-off valve (SVDL) of the pressure reduction passage (65) is slightly smaller in diameter than the passage, it provides resistance against refrigerant flow. As a result, a desired refrigerant circulating flow rate can be ensured.

On the other hand, the primary refrigerant in the primary side refrigerant circuit (20) discharges from the compressor (21) and then flows through the evaporation section of the refrigerant heat exchanger (11) to heat the secondary refrigerant in the secondary side refrigerant circuit (3A). Thereafter, the primary refrigerant having flowed through the refrigerant heat exchanger (11) flows through the receiver (25), evaporates in the condenser (22) and returns to the compressor (21). The primary refrigerant repeats this circulation.

Particularly in the first and third solutions, the primary refrigerant flowing out the refrigerant heat exchanger (11) flows into the container (2*a*) of the receiver (25) from the second pipe (2*c*) and then flows out from the first pipe (2*b*). At the time, since the opening of the first pipe (2*b*) is located at the upper position of the container (2*a*), the secondary refrigerant in liquid phase is hardly to flow out and the primary refrigerant in gas phase mainly flows out. As a result, it can be suppressed that the liquid refrigerant flows back to the compressor (21).

EFFECTS

According to the first, third and fourth solutions, since the first pipe (2*b*) in the receiver (25) of the primary side refrigerant circuit (20) is arranged to be open at the inside upper position of the container (2*a*), a large amount of liquid refrigerant can be stored in the receiver (25). As a result, the primary refrigerant in liquid phase during the defrosting operation can be controlled at a suitable flow rate.

Specifically, when the outside air temperature is high, the evaporation capability of the condenser (22) is increased and in this case the first pipe (2*b*) mainly sucks the primary refrigerant in gas phase. Therefore, the liquid refrigerant does not flow back to the compressor (21). As a result, a wet operation can be consistently prevented thereby providing enhanced reliability.

Particularly, a wet operation can be prevented even for a long pipe with a large amount of refrigerant charged thereinto, and a wet operation can be prevented with reliability even if reduction in evaporation capability of the condenser (22) through fan control is insufficient.

Further, according to the second, third and fourth solutions, since the first pipe (3*b*) in the receiver (34) of the secondary side refrigerant circuit (3A) is arranged to be open at the inside lower position of the container (3*a*), the secondary refrigerant in liquid phase is easy to flow out. As result, the primary refrigerant in liquid phase during the defrosting operation can be controlled at a suitable flow rate.

Specifically, in the secondary side refrigerant circuit (3A), the amount of refrigerant charged therein is small and the capacity of the evaporator (50) is large, but the secondary refrigerant in liquid phase flowing into the receiver (34) returns to the compressor (31) with reliability. As a result, the refrigerant circulating flow rate during the defrosting operation can be consistently ensured thereby providing enhanced defrosting capability.

Particularly, since the shut-off valve (SVDL) of the pressure reduction passage (65) is slightly smaller in diameter than the passage, it provides resistance against refrigerant flow. This resistance allows the suction side pressure of the compressor (31) to be held at a predetermined value and therefore the secondary refrigerant in liquid phase evaporates in the refrigerant heat exchanger (11) and returns to the compressor (31) with reliability. As a result, a desired refrigerant circulating flow rate can be consistently ensured.

BEST MODE FOR CARRYING OUT THE INVENTION

Hereinafter, an embodiment of the present invention will be described in detail with reference to the drawings.

Figure 1:
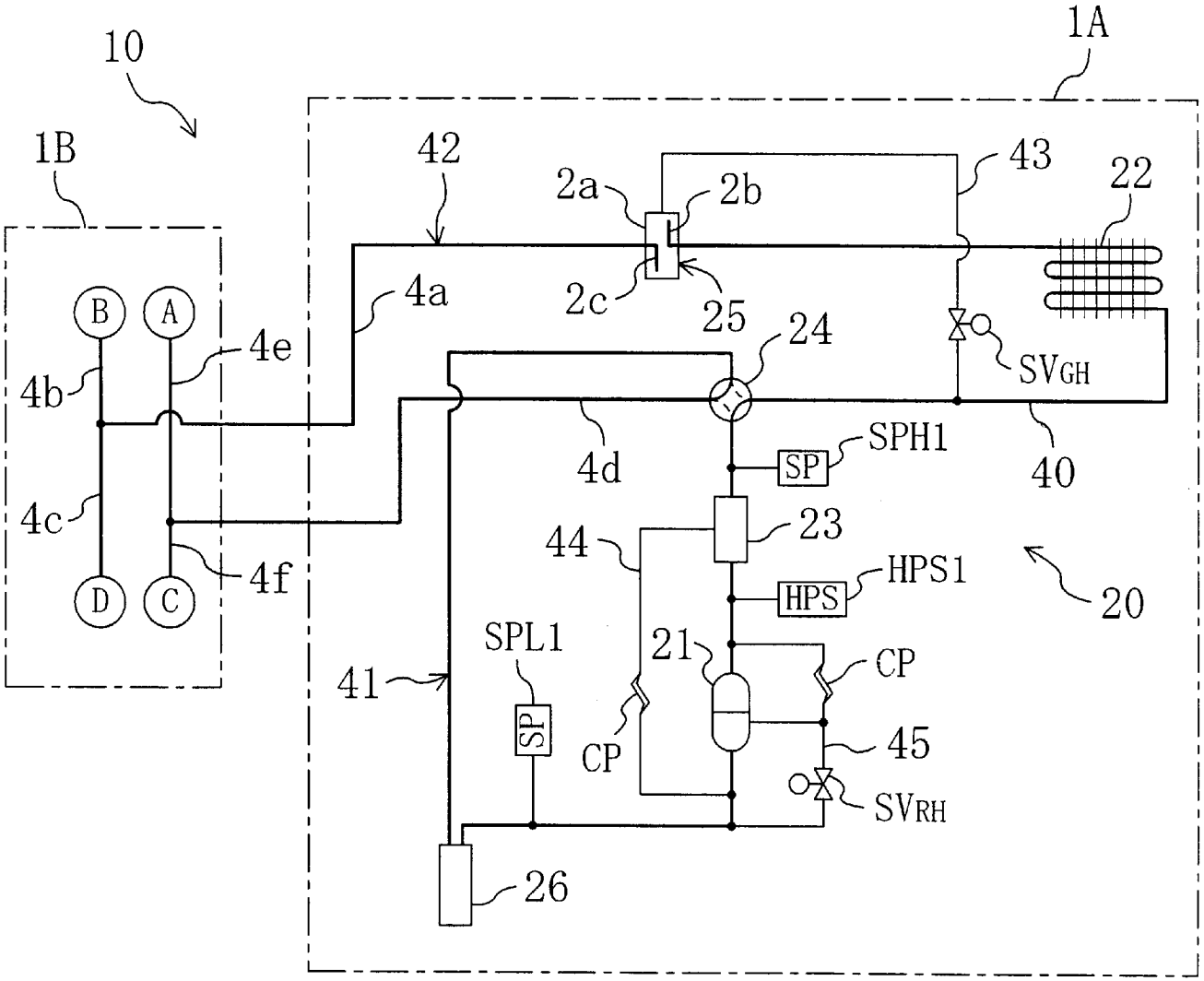
FIG. 1 is a refrigerant circuit diagram showing an essential part of a high temperature side refrigerating circuit in an embodiment of the present invention.
Figure 2:
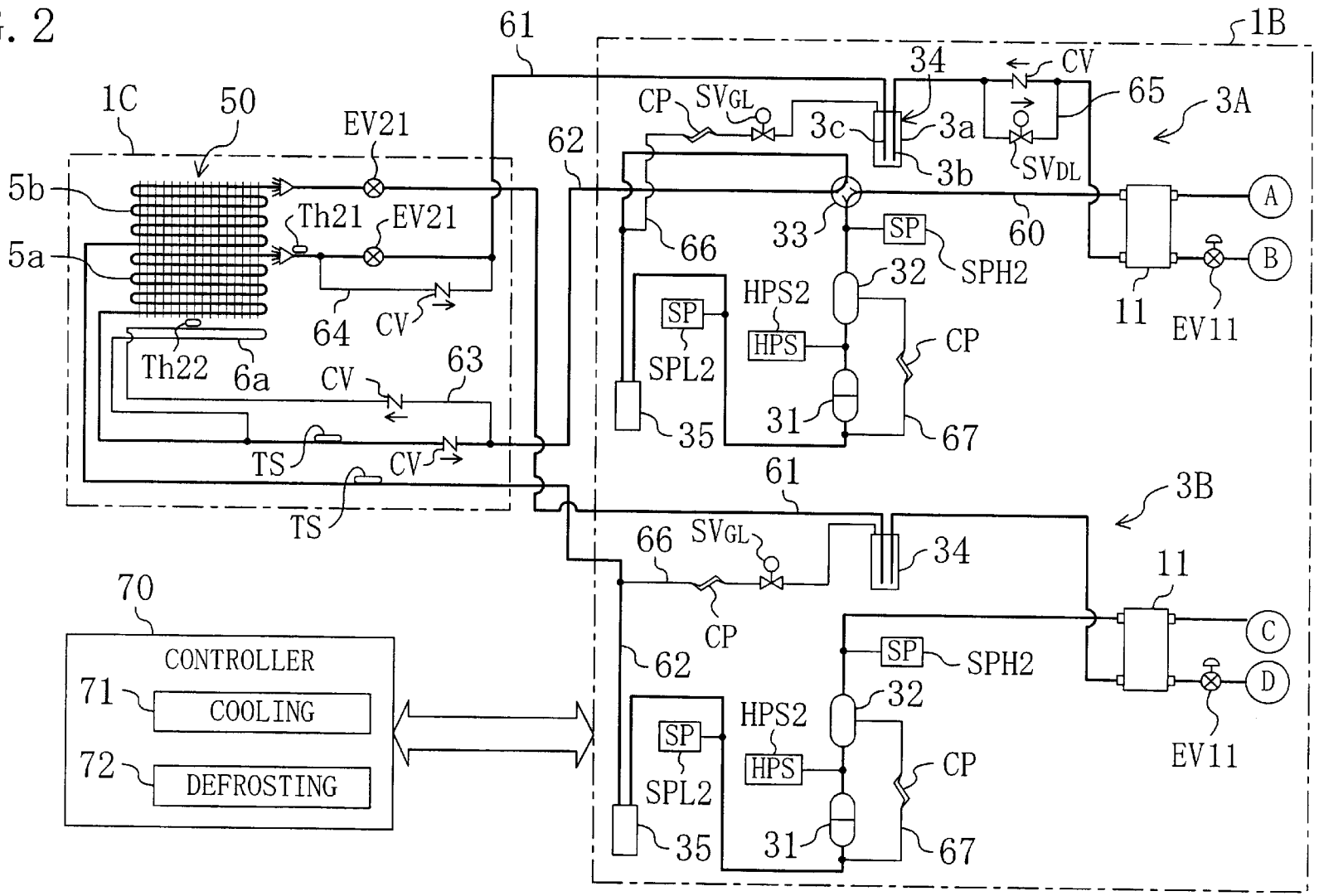
FIG. 2 is a refrigerant circuit diagram showing an essential part of a low temperature side refrigerating circuit in the embodiment of the present invention.

As shown in FIGS. 1 and 2, a two-stage cascade refrigerating system (10) is a system for cooling in a chiller or a freezer and includes an outdoor unit (1A), a cascade unit (1B) which is a heat exchange unit, and a cooling unit (1C). A high temperature side refrigerating circuit (20) is formed by the outdoor unit (1A) and part of the cascade unit (1B). On the other hand, two low temperature side refrigerating circuits (3A) and (3B) are formed over the cascade unit (1B) and the cooling unit (1C).

The high temperature side refrigerating circuit (20) constitutes a primary side refrigerant circuit that allows reversible operation by switching the direction of refrigerant circulation between a forward cycle and a reverse cycle. Further, the high temperature side refrigerating circuit (20) includes a compressor (21), a condenser (22) and evaporation sections of two refrigerant heat exchangers (11, 11).

A first gas pipe (40) is connected to the discharge side of the compressor (21) and a second gas pipe (41) is connected to the suction side thereof. The first gas pipe (40) starts with the compressor (21), connects an oil separator (23) and a four-way selector valve (24) in this order and is then connected to one end of the condenser (22). The other end of the condenser (22) is connected with one end of a liquid pipe (42). The liquid pipe (42) is constituted by a main pipe (4*a*) and two branch pipes (4*b*, 4*c*). The branch pipes (4*b*, 4*c*) are connected to the evaporation sections of the two refrigerant heat exchangers (11, 11), respectively.

The main pipe (4*a*) of the liquid pipe (42) starts with the condenser (22) and is connected to the branch pipes (4*b*, 4*c*) through the receiver (25). On the other hand, the branch pipes (4*b*, 4*c*) are provided with cooling motor-operated expansion valves (ELV11) which are expansion mechanisms, respectively.

The second gas pipe (41) is constituted by a main pipe (4*d*) and two branch pipes (4*e*, 4*f*). The main pipe (4*d*) of the second gas pipe (41) starts with the compressor (21), connects an accumulator (26) and the four-way selector valve (24) in this order. On the other hand, the branch pipes (4*e*, 4*f*) are connected to the evaporation sections of the refrigerant heat exchangers (11, 11), respectively. In other words, the evaporation sections of the two refrigerant heat exchangers (11, 11) are connected in parallel with each other in the high temperature side refrigerating circuit (20).

It is to be noted that the branch pipes (4*b*, 4*c*, 4*e*, 4*f*) of the liquid pipe (42) and the second gas pipe (41) are provided in the cascade unit (1B).

A gas passage (43) is connected between the first gas pipe (40) and the receiver (25). One end of the gas passage (43) is connected to a portion of the first gas pipe (40) located between the four-way selector valve (24) and the condenser (22). The other end of the gas passage (43) is connected to an upper portion of the receiver (25). The gas passage (43) is provided with a shut-off valve (SVGH) and arranged to effect high pressure control during a cooling operation.

An oil backing passage (44) equipped with a capillary tube (CP) is connected between the oil separator (23) and the suction side of the compressor (21). An unloading passage (45) of the compressor (21) which is equipped with a capillary tube (CP) and a shut-off valve (SVRH) is connected between the discharge and suction sides of the compressor (21). An intermediate portion of the unloading passage (45) is connected to the compressor (21).

The first gas pipe (40) on the discharge side of the compressor (21) is provided with a high-pressure sensor (PSH1) for sensing the pressure of a high-pressure refrigerant and a high-pressure switch (HPS1) for outputting an OFF signal when the pressure of the high-pressure refrigerant excessively rises up to a predetermined high-pressure value. Further, the second gas pipe (41) on the suction side of the compressor (21) is provided with a low-pressure sensor (PSL1) for sensing the pressure of a low-pressure refrigerant.

As a feature of the present invention, the receiver (25) includes a container (2*a*), a first pipe (2*b*) and a second pipe (2*c*). The container (2*a*) is formed into a closed container (2*a*). The first pipe (2*b*) and the second pipe (2*c*) are connected to the main pipe (4*a*) of the liquid pipe (42) as a liquid line.

One end of the first pipe (2*b*) communicates with the condenser (22). The first pipe (2*b*) is introduced to the inside of the container (2*a*) and bends upward from the mid-portion of the container (2*a*). Further, an opening end as the other end of the first pipe (2*b*) is located at an inside upper position of the container (2*a*).

One end of the second pipe (2*c*) communicates with the refrigerant heat exchangers (11, 11) through the cooling motor-operated expansion valves (EV11), respectively. The second pipe (2*c*) is introduced to the inside of the container (2*a*) and bends downward from the mid-portion of the container (2*a*). Further, an opening end as the other end of the second pipe (2*c*) is located at an inside lower position of the container (2*a*).

Accordingly, during the defrosting operation, a liquid refrigerant flows into the receiver (25) from the second pipe (2*c*) while a refrigerant flows out it from the first pipe (2*b*). At the time, since the first pipe (2*b*) is turned upward, a gas refrigerant mainly flows through the first pipe (2*b*).

On the other hand, the first low temperature side refrigerating circuit (3A) constitutes a secondary side refrigerant circuit that allows reversible operation by switching the direction of refrigerant circulation between a forward cycle and a reverse cycle. Further, the first low temperature side refrigerating circuit (3A) includes a compressor (31), a condensation section of the first refrigerant heat exchanger (11) and evaporating heat transfer piping (5*a*).

The discharge side of the compressor (31) is connected to one end of the condensation section of the first refrigerant heat exchanger (11) via an oil separator (32) and a four-way selector valve (33) by a first gas pipe (60). The other end of the condensation section is connected to one end of the evaporating heat transfer piping (5*a*) via a check valve (CV), a receiver (34) and a cooling expansion valve (EV21) as an expansion mechanism by a liquid pipe (61). The other end of the evaporating heat transfer piping (5*a*) is connected to the suction side of the compressor (31) via a check valve (CV), the four-way selector valve (33) and an accumulator (35) by a second gas pipe (62).

The first refrigerant heat exchanger (11) is a cascade condenser and is arranged to mainly exchange heat of evaporation in the high temperature side refrigerating circuit (20) with heat of condensation in the first low temperature side refrigerating circuit (3A).

It is to be noted that the cooling expansion valve (EV21) is a temperature-sensitive expansion valve and a temperature-sensing bulb (TS) is disposed in the second gas pipe (62) located on the outlet side of the evaporating heat transfer piping (5*a*).

The first low temperature side refrigerating circuit (3A) effects a defrosting operation in a reverse cycle and therefore includes a drain pan passage (63), a gas bypass passage (64) and a pressure reduction passage (65). The drain pan passage (63) is connected to both ends of the check valve (CV) in the second gas passage (62). The drain pan passage (63) is provided with a drain pan heater (6*a*) and a check valve (CV) and a refrigerant (hot gas) discharged from the compressor (31) flows therethrough.

The gas bypass passage (64) is connected to both ends of the cooling expansion valve (EV21) in the liquid pipe (61). The gas bypass passage (64) includes a check valve (CV) and is arranged so that a liquid refrigerant bypasses the cooling expansion valve (EV21) during the defrosting operation.

As a feature of the present invention, the receiver (34) includes a container (3*a*), a first pipe (3*b*) and a second pipe (3*c*). The container (3*a*) is formed into a closed container (3*a*). The first pipe (3*b*) and the second pipe (3*c*) are connected to the liquid pipe (61) which is a liquid line.

One end of the first pipe (3*b*) communicates with the refrigerant heat exchanger (11). The first pipe (3*b*) is introduced to the inside of the container (3*a*) and bends downward from the mid-portion of the container (3*a*). Further, an opening end as the other end of the first pipe (3*b*) is located at an inside lower position of the container (3*a*).

One end of the second pipe (3*c*) communicates with the evaporating heat transfer piping (5*a*) through the cooling motor-operated expansion valve (EV21). The second pipe (3*c*) is introduced to the inside of the container (3*a*) and bends downward from the mid-portion of the container (3*a*). Further, an opening end as the other end of the second pipe (3*c*) is located at an inside lower position of the container (3*a*).

Accordingly, during the defrosting operation, a liquid refrigerant flows into the receiver (34) from the second pipe (3*c*) while a refrigerant flows out it from the first pipe (3*b*). At the time, since the first pipe (3*b*) and the second pipe (3*c*) are turned downward, the liquid refrigerant is easy to flow.

As another feature of the present invention, the pressure reduction passage (65) is connected to both ends of the check valve (CV) in the liquid pipe (61) and includes a shut-off valve (SVDL). The shut-off valve (SVDL) is set to have a slightly smaller diameter than that of the pressure reduction passage (65) and opens during the defrosting operation. Further, the shut-off valve (SVDL) is arranged so that flow resistance of the refrigerant becomes large during the defrosting operation.

An upper portion of the receiver (34) is connected with one end of a degassing passage (66). The degassing passage (66) includes a shut-off valve (SVGL) and a capillary tube (CP). Further, the other end of the degassing passage (66) is connected to a location on the second gas pipe (62) upstream of the accumulator (35).

An oil backing passage (67) including a capillary tube (CP) is connected between the oil separator (32) and the suction side of the compressor (31).

The first gas pipe (60) on the discharge side of the compressor (31) is provided with a high-pressure sensor (PSH2) for sensing the pressure of a high-pressure refrigerant and a high-pressure switch (HPS2) for outputting an OFF signal when the pressure of the high-pressure refrigerant excessively rises up to a predetermined high-pressure value. The second gas pipe (62) on the suction side of the compressor (31) is provided with a low-pressure sensor (PSL2) for sensing the pressure of a low-pressure refrigerant.

The second low temperature side refrigerating circuit (3B) has substantially the same configuration as that of the first low temperature side refrigerating circuit (3A) but constitutes a secondary side refrigerant circuit that effects a cooling operation alone without effecting a defrosting operation. The second low temperature side refrigerating circuit (3B) does not include such a four-way selector valve (24) as included in the first low temperature side refrigerating circuit (3A). Furthermore, the second low temperature side refrigerating circuit (3B) is not provided with a drain pan passage (63), a gas bypass passage (64) and a pressure reduction passage (65).

In other words, the second low temperature side refrigerating circuit (3B) is formed by connecting a compressor (31), a condensation section of the second refrigerant heat exchanger (11), a receiver (34), a cooling expansion valve (EV21), evaporating heat transfer piping (5*b*) and an accumulator (35) in this order by a first gas pipe (60), a liquid pipe (61) and a second gas pipe (62).

The cooling expansion valve (EV21) is a temperature-sensitive expansion valve and a temperature-sensing bulb is disposed in the second gas pipe (62) located on the outlet side of the evaporating heat transfer piping (5*b*). The second refrigerant heat exchanger (11) is a cascade condenser and is arranged to exchange heat of evaporation in the high temperature side refrigerating circuit (20) with heat of condensation in the second low temperature side refrigerating circuit (3B).

The evaporating heat transfer piping (5*a*, 5*b*) of both the low temperature side refrigerating circuits (3A, 3B), the cooling expansion valve (EV21) and the drain pan passage (63) are disposed in the cooling unit (1C), while other components such as the compressor (31) are disposed in the cascade unit (1B).

The evaporating heat transfer piping (5*a*, 5*b*) of both the low temperature side refrigerating circuits (3A, 3B) each constitute an evaporator as shown in FIG. 2 but in this embodiment they are formed unitarily into a single evaporator (50). Specifically, the evaporating heat transfer piping (5*a,* 5*b*) of each low temperature side refrigerating circuit (3A, 3B) is formed of n pipes and the evaporator (50) is accordingly constituted by evaporating heat transfer piping (5*a,* 5*b*) of 2n pipes, i.e., formed into 2n paths.

Further, a liquid temperature sensor (Th21) for sensing the temperature of a liquid refrigerant is disposed at a location on the liquid pipe (61) upstream of the evaporating heat transfer piping (5*a*) in the first low temperature side refrigerating circuit (3A). An evaporator temperature sensor (Th22) for sensing the temperature of the evaporator (50) is disposed on the evaporator (50).

The high temperature side refrigerating circuit (20) and both the low temperature side refrigerating circuits (3A, 3B) are controlled by a controller (70). The controller (70) inputs detection signals of the high-pressure sensors (PSH1, PSH2) and so on and outputs control signals for the compressors (21, 31) and so on. The controller (70) is provided with a cooling means (71) for controlling a cooling operation and additionally a defrosting means (72).

The defrosting means (72) is arranged to effect a defrosting operation at predetermined time intervals. Specifically, the defrosting means (72) is arranged to shut down the operation of the second low temperature side refrigerating circuit (3B) and switch the four-way selector valves (24) of the first low temperature side refrigerating circuit (3A) and the high temperature side refrigerating circuit (20) to port connections as shown in broken lines in FIGS. 1 and 2 thereby changing the directions of refrigerant circulation in these circuits to circulate the refrigerants in the respective reverse cycles.

-Behavior of Two-stage Cascade Refrigerating System in Operation-

Behavior of the above-described two-stage cascade refrigerating system (10) in operation will be next described.

First, in carrying out a cooling operation, the compressor (21) in the high temperature side refrigerating circuit (20) and the two compressors (31, 31) in both the low temperature side refrigerating circuits (3A, 3B) are actuated together. Under these conditions, in the high temperature side refrigerating circuit (20), the four-way selector valve (24) is operated to select its port connection shown in solid lines in FIG. 1 and the opening control of the cooling motor-operated expansion valve (EV11) is carried out.

A primary refrigerant discharged from the compressor (21) in the high temperature side refrigerating circuit (20) condenses into a liquid refrigerant in the condenser (22) and then flows into the cascade unit (1B). The liquid refrigerant is then distributed between the two branch pipes (4*b,* 4*c*) and reduced in pressure in the cooling motor-operated expansion valves (EV11) Thereafter, the liquid refrigerant evaporates into a gas refrigerant in each of the evaporation sections of the two refrigerant heat exchangers (11, 11) and returns to the compressor (21). The refrigerant repeats this circulation.

On the other hand, in the first low temperature side refrigerating circuit (3A), the four-way selector valve (33) is operated to select its port connection shown in solid lines in FIG. 2, the shut-off valve (SVDL) of the pressure reduction passage (65) is closed and the cooling expansion valve (EV21) is controlled as to the superheating degree. In the second low temperature side refrigerating circuit (3B), the cooling expansion valve (EV21) is controlled as to the superheating degree.

In both the low temperature side refrigerating circuits (3A, 3B), secondary refrigerants discharged from the compressors (31, 31) condense into liquid refrigerants in the condensation sections of the refrigerant heat exchangers (11, 11), respectively. These liquid refrigerants are reduced in pressure in the cooling expansion valves (EV21). Thereafter, the liquid refrigerants evaporate into gas refrigerants in the two evaporating heat transfer piping sets (5*a,* 5*b*), respectively, and return to the compressors (31, 31). The refrigerants repeat such circulation.

Further, in each of the refrigerant heat exchangers (11, 11), heat of evaporation in the high temperature side refrigerating circuit (20) is exchanged with heat of condensation in each of the low temperature side refrigerating circuits (3A, 3B) so that the secondary refrigerants in the low temperature side refrigerating circuits (3A, 3B) are cooled to condense. On the other hand, in the evaporator (50), the secondary refrigerants evaporate to generate cooled air and the cooled air cools the inside of a storage.

The two-stage cascade refrigerating system (10) also effects a defrosting operation. This defrosting operation is carried out every 6 hours during a chilling operation and every 12 hours during a freezing operation. The defrosting operation is carried out by shutting down the operation of the second low temperature side refrigerating circuit (3B) and changing the directions of refrigerant circulation in the first low temperature side refrigerating circuit (3A) and the high temperature side refrigerating circuit (20) to the respective reverse cycles.

Specifically, in the first low temperature side refrigerating circuit (3A), the four-way selector valve (33) is operated to select its port connection shown in the broken lines in FIG. 2, the shut-off valve (SVDL) of the pressure reduction passage (65) is fully opened, and the cooling expansion valve (EV21) is fully closed.

The secondary refrigerant discharged from the compressor (31) passes from the four-way selector valve (33) through the drain pan passage (63) and heats a drain pan in the drain pan heater (6*a*). Subsequently, the secondary refrigerant heats the evaporator (50) while flowing through the evaporating heat transfer piping (5*a*) thereby melting frost on the evaporator (50). The secondary refrigerant having flowed through the evaporating heat transfer piping (5*a*) then flows through the gas bypass passage (64), passes through the receiver (34) into the pressure reduction passage (65) and reduces its pressure in the shut-off valve (SVDL) Subsequently, the secondary refrigerant evaporates in the condensation section of the refrigerant heat exchanger (11), passes through the four-way selector valve (33) and the accumulator (35) and returns to the compressor (31). The secondary refrigerant repeats this circulation.

Particularly as a feature of the present invention, the secondary refrigerant having flowed out the evaporating heat transfer piping (5*a*) flows into the container (3*a*) of the receiver (34) from the second pipe (3*c*) and flows out it from the first pipe (3*b*). At the time, since the opening end of the first pipe (3*b*) is located at the lower position of the container (3*a*), the secondary refrigerant in liquid phase is easy to flow out. Further, since the shut-off valve (SVDL) of the pressure reduction passage (65) has a slightly smaller diameter than that of the passage, it provides resistance against refrigerant flow. As a result, the suction side pressure of the compressor (31) can be held at a predetermined low pressure thereby ensuring a desired refrigerant circulating flow rate.

On the other hand, in the high temperature side refrigerating circuit (20), the four-way selector valve (24) is operated to select its port connection shown in the broken lines in FIG. 1 and the cooling motor-operated expansion valve (EV11) is fully opened.

The primary refrigerant discharged from the compressor (21) flows into the evaporation section of the first refrigerant heat exchanger (11) through the four-way selector valve (24) to heat the secondary refrigerant in the first low temperature side refrigerating circuit (3A). The primary refrigerant having flowed through the evaporation section of the first refrigerant heat exchanger (11) then passes through the receiver (25), evaporates in the condenser (22), passes through the four-way selector valve (24) and the accumulator (26) and returns to the compressor (21). The primary refrigerant repeats this circulation.

Particularly as a feature of the present invention, the primary refrigerant having flowed out the refrigerant heat exchanger (11) flows into the container (2*a*) of the receiver (25) from the second pipe (2*c*) and flows out it from the first pipe (2*b*). At the time, since the opening end of the first pipe (2*b*) is located at the upper position of the container (2*a*), the secondary refrigerant in liquid phase is hardly to flow out and the primary refrigerant in gas phase mainly flows out. As a result, it can be suppressed that the primary refrigerant in liquid phase flows back to the compressor (21).

Further, the defrosting operation terminates when the liquid temperature sensor (Th22) senses, for example, a refrigerant temperature of 35° C. and the evaporator temperature sensor (Th22) senses, for example, an evaporator temperature of 5° C. or when the high-pressure sensor (PSH2) in the first low temperature side refrigerating circuit (3A) senses, for example, a high-pressure refrigerant pressure of 18 kg/cm$^2$. It is to be noted that the defrosting operation also terminates in accordance with a 1-hour guard timer.

Not only during the defrosting operation but also during the cooling operation, the shut-off valve (SVGL) of the degassing passage (66) in each of the low temperature side refrigerating circuits (3A, 3B) is opened to return the liquid refrigerant stored in the receiver (34) to the low temperature side compressor (31).

Furthermore, during the cooling operation, when the pressure of the high-pressure refrigerant sensed by the high-pressure sensor (PSH1) is decreased, the gas passage (43) in the high temperature side refrigerating circuit (20) opens the shut-off valve (SVGH) to feed the high-pressure refrigerant to the receiver (25). The pressure of the high-pressure refrigerant thereby rises.

-Effects of Embodiment-

As can be seen from the above, according to the present embodiment, since the first pipe (2*b*) in the receiver (25) of the high temperature side refrigerating circuit (20) is arranged to be open at the inside upper position of the container (2*a*), a large amount of liquid refrigerant can be stored in the receiver (25). As a result, the primary refrigerant in liquid phase during the defrosting operation can be controlled at a suitable flow rate.

Specifically, when the outside air temperature is high, the evaporation capability of the condenser (22) is increased and in this case the first pipe (2*b*) mainly sucks the primary refrigerant in gas phase. Therefore, the liquid refrigerant does not flow back to the compressor (21). As a result, a wet operation can be consistently prevented thereby providing enhanced reliability.

Particularly, a wet operation can be prevented even for a long pipe with a large amount of refrigerant charged thereinto, and a wet operation can be prevented with reliability even if reduction in evaporation capability of the condenser (22) through fan control is insufficient.

Further, since the first pipe (3*b*) in the receiver (34) of the first low temperature side refrigerating circuit (3A) is arranged to be open at the inside lower position of the container (3*a*), the secondary refrigerant in liquid phase is easy to flow out. As a result, the primary refrigerant in liquid phase during the defrosting operation can be controlled at a suitable flow rate.

Specifically, in the first low temperature side refrigerating circuit (3A), the amount of refrigerant charged therein is small and the capacity of the evaporator (50) is large, but the secondary refrigerant in liquid phase flowing into the receiver (34) returns to the compressor with reliability. As a result, the refrigerant circulating flow rate during the defrosting operation can be consistently ensured thereby providing enhanced defrosting capability.

Particularly, since the shut-off valve (SVDL) of the pressure reduction passage (65) is slightly smaller in diameter than the passage, it provides resistance against refrigerant flow. This resistance allows the suction side pressure of the compressor (31) to be held at a predetermined value and therefore the secondary refrigerant in liquid phase evaporates in the refrigerant heat exchanger (11) and returns to the compressor (31) with reliability. As a result, a desired refrigerant circulating flow rate can be consistently ensured.

-Other Embodiments-

In the above embodiment, two low temperature side refrigerating circuits (3A, 3B) are provided. However, the present invention may include a single low temperature side refrigerating circuit (3A). On the contrary, the present invention may include three or more first low temperature side refrigerating circuits (3A, 3B, . . . ).

INDUSTRIAL APPLICABILITY

As can be seen from the above, the two-stage cascade refrigerating system according to the present invention is useful for chillers, freezers and so on, and particularly suitable for systems which effect a defrosting operation in a reverse cycle.

What is claimed is:

1. A two-stage cascade refrigerating system including: a primary side refrigerant circuit (20) which is formed by connecting a compressor (21), a condenser (22), an expansion mechanism (EV11) and an evaporation section of a refrigerant heat exchanger (11) in this order and in which a primary refrigerant circulates and a receiver (25) is disposed in a liquid line; and at least one secondary side refrigerant circuit (3A) which is formed by connecting a compressor (31), a condensation section f the refrigerant heat exchanger (11), an expansion mechanism (EV21) and an evaporator (5A) in this order and in which a secondary refrigerant circulates, a receiver (34) is disposed in a liquid line and the primary refrigerant exchanges heat with the secondary refrigerant in the refrigerant heat exchanger (11), characterized in that said at least one secondary side refrigerant circuit (3A) and the primary side refrigerant circuit (20) are arranged to make the direction of refrigerant circulation reversible between a forward cycle and a reverse cycle, and the receiver (25) of the primary side refrigerant circuit (20) includes a container (2*a*), a first pipe (2*b*) which communicates with the condenser (22) and is introduced to the inside of the container (2*a*) and an opening end of which is located at an inside upper position of the container (2*a*), and a second pipe (2*c*) which communicates with the refrigerant heat exchanger (11) and is introduced to the inside of the container (2*a*) and an opening end of which is located at an inside lower position of the container (2*a*), and the receiver (34) of the secondary side refrigerant circuit (3A) reversible in refrigerant circulation includes a container (3*a*), a first pipe (3*b*) which communicates with the refrigerant heat exchanger (11) and is introduced to the inside of the container (3*a*) and an opening end of which is located at an inside lower position of the container (3*a*), and a second pipe (3*c*) which communicates with the evaporator (5*a*) and is introduced to the inside of the container (3*a*) and an opening end of which is located at an inside lower position of the container (3*a*).

2. The two-stage cascade refrigerating system of claim 1, characterized in that during the reverse cycle of refrigerant circulation, the refrigerant pressure is reduced between the refrigerant heat exchanger (11) and the receiver (34) in the secondary side refrigerant circuit (3A) reversible in refrigerant circulation.

3. The two-stage cascade refrigerating system of claim 2, further comprising a pressure reduction passage (65) for allowing the flow of the secondary refrigerant therethrough during the reverse cycle of refrigerant circulation alone is provided between the refrigerant heat exchanger (11) and the receiver (34) in the secondary side refrigerant circuit (3A) reversible in refrigerant circulation, the pressure reduction passage (65) being provided with a shut-off valve (SVDL) smaller in diameter than the passage.

4. The two-stage cascade refrigerating system of claim 1, characterized in that:

a plurality of refrigerant heat exchangers (11, 11) are provided;

the evaporation sections of the refrigerant heat exchangers (11, 11) are connected in parallel with each other to form the primary refrigerant circuit (20);

the refrigerant heat exchangers (11, 11) are connected with the secondary side refrigerant circuits (3A, 3B), respectively;

at least one secondary side refrigerant circuit (3A) of the plurality of secondary side refrigerant circuits (3A, 3B) is arranged to make refrigerant circulation therein reversible; and the evaporators (5*a*, 5*b*) of the secondary side refrigerant circuits (3A, 3B) are formed unitarily.

* * * * *